US009080302B2

(12) United States Patent
Jung

(10) Patent No.: US 9,080,302 B2
(45) Date of Patent: Jul. 14, 2015

(54) MEASUREMENT SYSTEM FOR A PILE

(75) Inventor: Boudewijn Casper Jung, Bergen op Zoom (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 14/008,773

(22) PCT Filed: Mar. 27, 2012

(86) PCT No.: PCT/NL2012/050194

§ 371 (c)(1),
(2), (4) Date: Sep. 30, 2013

(87) PCT Pub. No.: WO2012/134279

PCT Pub. Date: Oct. 4, 2012

(65) Prior Publication Data

US 2014/0023442 A1 Jan. 23, 2014

(30) Foreign Application Priority Data

Mar. 28, 2011 (NL) ..... 2006477

(51) Int. Cl.
*E02D 13/06* (2006.01)

(52) U.S. Cl.
CPC ..... *E02D 13/06* (2013.01)

(58) Field of Classification Search
CPC ..... E02D 13/02; E02D 13/06; E02D 35/00
USPC ..... 405/231, 232; 33/304, 313
See application file for complete search history.

(56) References Cited

U.S. PATENT DOCUMENTS

| | | | | | |
|---|---|---|---|---|---|
| 3,001,592 | A * | 9/1961 | Lucas | 175/8 |
| 3,452,830 | A * | 7/1969 | Mastropole et al. | 175/55 |
| 4,293,046 | A * | 10/1981 | Van Steenwyk | 340/853.8 |
| 4,343,570 | A * | 8/1982 | Myer, II | 405/229 |
| 4,395,829 | A * | 8/1983 | Loftus | 33/352 |
| 4,627,170 | A * | 12/1986 | McKechnie | 33/645 |
| 2006/0233617 | A1 * | 10/2006 | Shotton et al. | 405/232 |
| 2006/0254068 | A1 * | 11/2006 | Shotton et al. | 33/544 |
| 2012/0315097 | A1 * | 12/2012 | Paulus et al. | 405/224 |

FOREIGN PATENT DOCUMENTS

| | | | |
|---|---|---|---|
| FR | 2 407 457 | A1 | 5/1979 |
| GB | 2 399 413 | A | 9/2004 |
| JP | 57 201422 | A | 12/1982 |
| JP | 63 236819 | A | 10/1988 |
| JP | 1 039516 | A | 2/1989 |

OTHER PUBLICATIONS

International Search Report, dated Apr. 27, 2012, from corresponding PCT application.

* cited by examiner

*Primary Examiner* — Benjamin Fiorello
(74) *Attorney, Agent, or Firm* — Young & Thompson

(57) ABSTRACT

A measuring system for controlling perpendicularity of a pile during driving of the pile includes a mounting frame for coupling the measuring system with a pile driving system, and a measuring frame provided with at least one measuring device for measuring perpendicularity of the pile. The measuring frame can be moveably coupled with the mounting frame.

18 Claims, 5 Drawing Sheets

MEASUREMENT SYSTEM FOR A PILE

BACKGROUND

The present invention relates to a measuring system for controlling perpendicularity of a pile during driving of the pile, in particular perpendicularity of an offshore pile which pile may have a typical diameter of about 5 m and a length of 60 m.

JP 57201422 (A) discloses a method in which a leader is positioned at a set place on the basis of detected angle on the leader side, and then a pile is positioned at a set angle on the basis of detected angle on the pile side in order to raise the accuracy of driving a pile. A drawback of this method is that the detector is exposed to considerable accelerations during driving of the pile, which accelerations may exceed 2000 [g]. This severe condition limits the suitability and the choice of detectors.

FR2407457 A1 discloses a device for detection of perpendicularity per se for use with a pile.

SUMMARY OF THE INVENTION

The invention aims to solve at least partly a drawback of a known measuring system for controlling perpendicularity of a pile during driving of the pile.

Another object of the invention is in particular to improve the conditions for a detector for a measuring system for controlling perpendicularity of a pile during driving of the pile.

Yet another object of the invention is to provide an alternative measuring system for controlling perpendicularity of a pile during driving of the pile.

According to a first aspect of the invention this is realized with a measuring system for controlling perpendicularity of a pile during driving of the pile, wherein the measurement system comprises;

- a mounting frame for coupling the measuring system with a pile driving system,
- a measuring frame provided with at least one measuring device for measuring perpendicularity, the measuring frame being moveably coupled with the mounting frame and moveable between a first position for engaging the pile for measuring the perpendicularity of the pile, and a second position for engaging the pile driving system for measuring perpendicularity of the pile driving system.

This enables measuring the perpendicularity of the pile without the measuring device being coupled with the pile. Such coupling would expose the measuring device to severe accelerations caused by the driving, in particular hammering of the pile. In addition this enables measuring the perpendicularity of both the pile and the pile driving system independently. In addition, a common manual measurement of the perpendicularity of the pile at deck level can be dispensed with. The perpendicularity of the pile itself is important in view of its supporting function for e.g. a windmill. The perpendicularity of the pile driving system is important in view of the effectiveness of the pile driving process.

Perpendicularity of the pile is in particularly the deviation of the pile, specifically the longitudinal axis of the pile, from the true vertical. The measuring device provided with the measuring frame is e.g. an inclinometer for measuring angles of slope, also tilt, of an object with respect to gravity. In practice a deviation of the pile from the vertical may be 5 mm/m at most.

The measurement system engages the pile at a reference plane for measuring perpendicularity, which reference plane may for example be the outer circumference of the pile or a top surface of the pile. The measurement system may engage the pile direct or indirect via for example a striking plate.

The perpendicularity of the pile driving system refers to the line of action of the pile driving system which line of action in many cases ideally corresponds with the true vertical.

In an embodiment of the invention the measuring system comprises a pretensioning system coupled with the mounting frame and the measuring frame for driving and/or pretensioning the measuring frame towards one of the first and the second position for measuring perpendicularity in a reproducible manner.

The pretensioning system enables a repeatable and reproducible measuring of the perpendicularity of both the pile and the pile driving system.

In an embodiment of the invention, the pretension system comprises a passive resilient member for pretensioning the measuring frame towards one of the first and the second position.

In an embodiment of the invention, the pretension system comprises a measuring frame driving system for pretensioning the measuring frame towards the other of the first and the second position.

In an embodiment of the invention, the passive resilient member is arranged for pretensioning the measuring frame towards the second position, and the frame driving system is arranged for pretensioning the measuring frame towards the first position.

Therefore, without activation, the measuring device is default decoupled from the pile which is beneficial in view of shock loads of the measuring device.

In an embodiment of the invention, the pretensioning system, in use, has line of action along which line the measuring frame is moveable between the first and second position, wherein the line of action is substantially horizontal.

In an embodiment of the invention, the measuring frame comprises at least two measuring frame stop surfaces for statically determined engaging the pile for measuring perpendicularity of the pile.

In an embodiment of the invention, the measuring frame comprises at least two further measuring frame stop surfaces for statically determined engaging the pile driving system for measuring perpendicularity of the pile driving system.

In an embodiment of the invention, the at least two further measuring frame stop surfaces are arranged for statically determined engaging the mounting frame for measuring perpendicularity of the pile driving system.

In an embodiment of the invention, the at least two measuring frame stop surfaces for statically determined engaging the pile are provided with a first side of the measuring frame and the at least two further measuring frame stop surfaces for statically determined engaging the pile driving system are provided with a second side of the measuring frame, said second side being opposite relative to said first side.

This facilitates the measuring frame being held in a determined way by the pretension system without play, in particular the measuring frame being held between the passive resilient member and the measuring frame drive system of the pretension system.

In an embodiment of the invention, the mounting frame comprises at least two mounting frame stop surfaces for the pile driving system being statically determined engaged by the measuring frame via the mounting frame for measuring perpendicularity of the pile driving system.

This enables measuring of the perpendicularity of the pile driving system in a repeatable and reproducible way.

In an embodiment of the invention, the measuring system comprises an elongate member for coupling the measuring frame with the pile for measuring the perpendicularity of the pile, wherein the elongate member extends from the measuring frame for facing the pile and engaging the pile for measuring the perpendicularity of the pile.

This facilitates coupling the measuring system, specifically the measuring frame thereof, with the pile through a sleeve member which sleeve member couples the pile with a pile driving device. In addition, it enables the measuring system being mounted on the exterior of the sleeve member away from the pile, which exterior of the sleeve is a less harsh environment for a measuring system.

The invention further relates to a pile driving system comprising;

a pile guiding system for coupling the pile with a vessel, the pile guiding system preferably having an elongate leader and a saddle, a pile driving device, a measurement system according to the invention, coupled with the pile driving device or with the pile guiding system.

In an embodiment of the pile driving system, the measurement system is coupled with a reference plane of the pile, in particular the outer circumference or the top surface of the pile.

In an embodiment of the pile driving system, the measurement system is coupled with the outer circumference for measuring perpendicularity of the pile.

In an embodiment of the pile driving system, the measurement system is coupled with the top surface of the pile for measuring deviation of the top surface with the true horizontal. This is useful when subsequent pile sections need to be placed on top of each other and joined together, usually welded together.

The invention further relates to a method for driving a pile using a measuring system according to the invention, comprising at least once executing the step of, moving, specifically tilting, the measuring frame between the first and the second position for measuring the perpendicularity of one of the pile and a pile driving system using one and the same measuring frame.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to a preferred embodiment shown in the drawing wherein shown in.

DETAILED DESCRIPTION OF EMBODIMENTS

Figure 1:
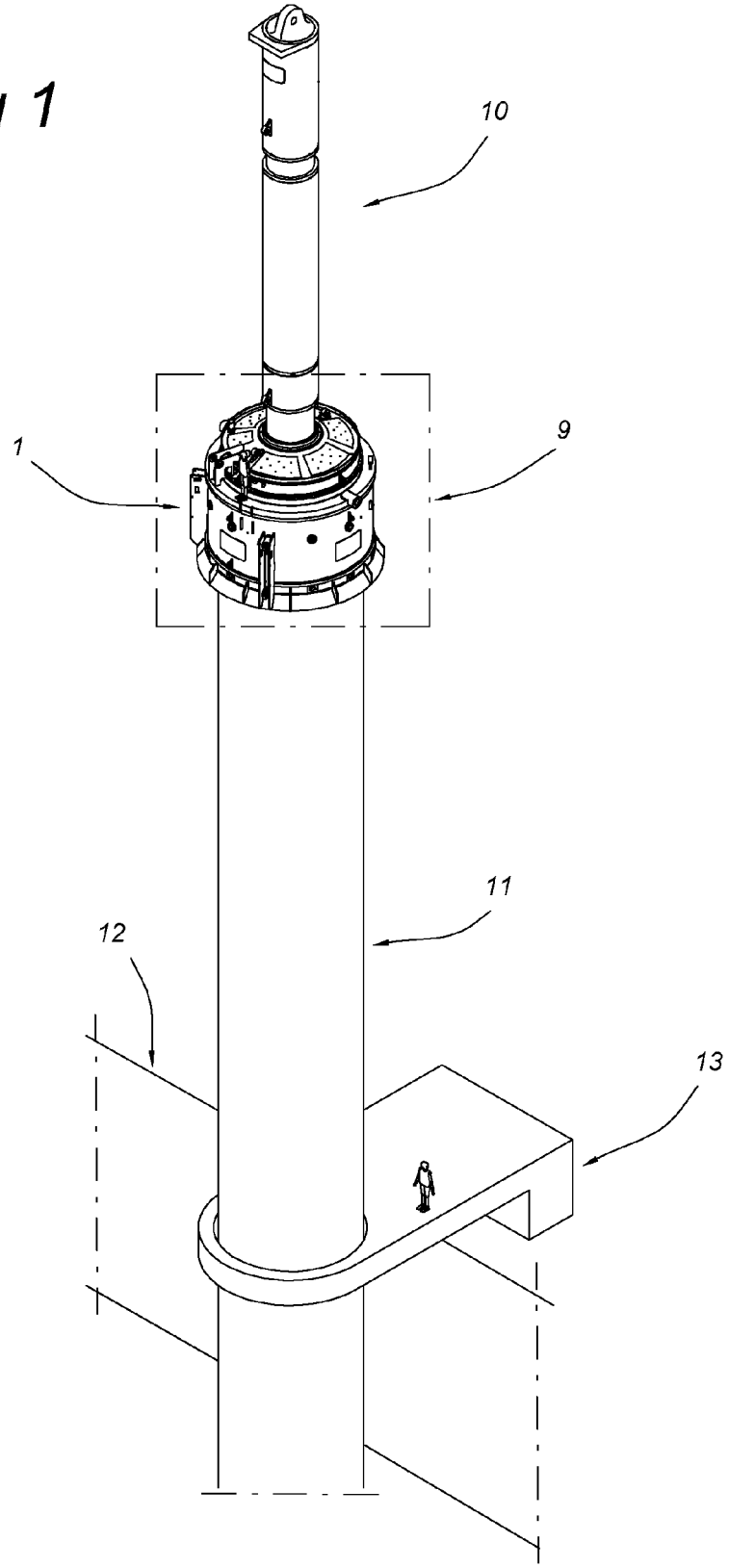
FIG. 1 in perspective view a pile driving system with a measuring system according to the invention; and in FIG. 2 a detail of FIG. 1 which shows two measuring systems according to the invention, FIG. 3 a cross sectional side view of a measuring system according to the invention, FIG. 4 a detail of FIG. 3, and FIG. 5 a pile driving system having a measuring system of FIG. 1-4.
Figure 2:
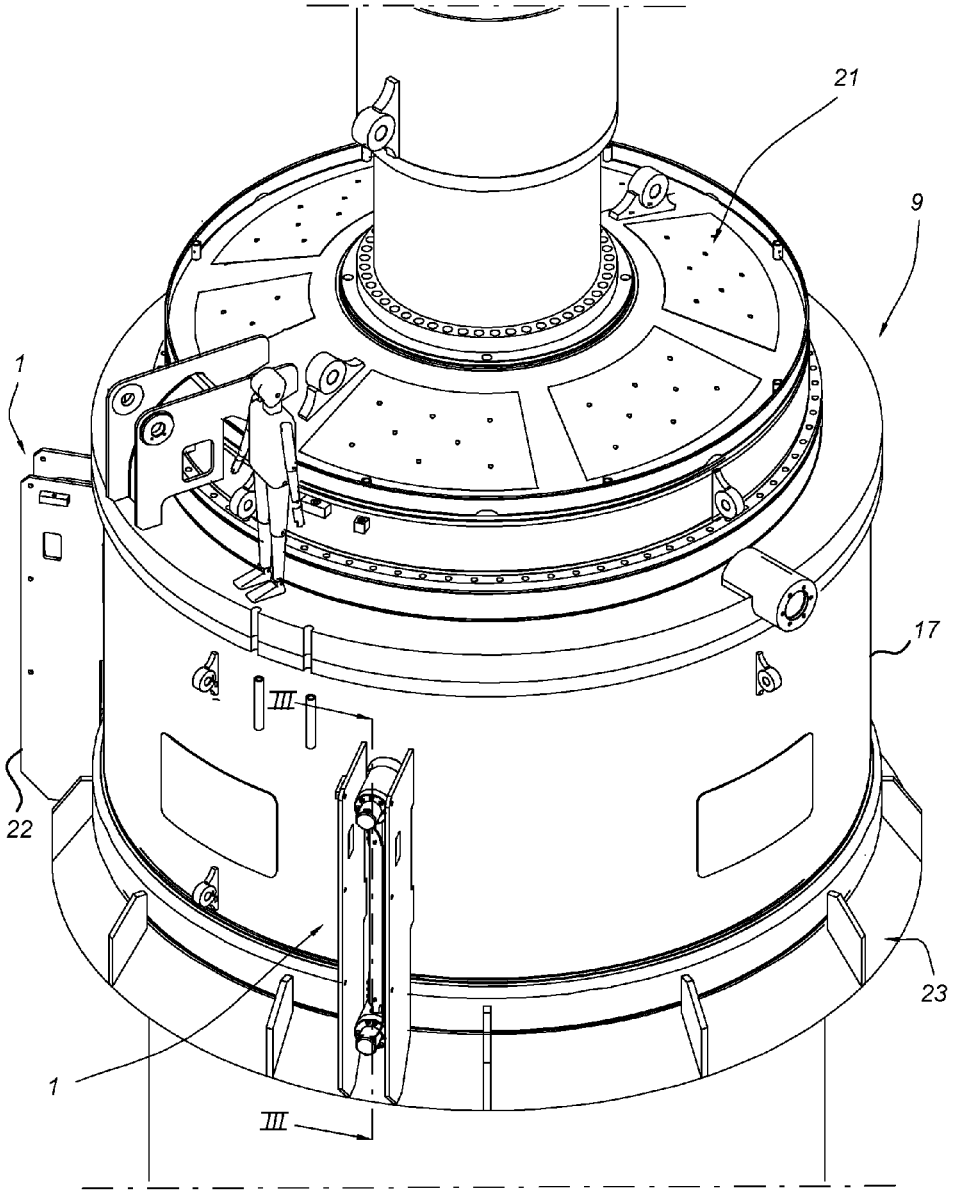
Figure 3:
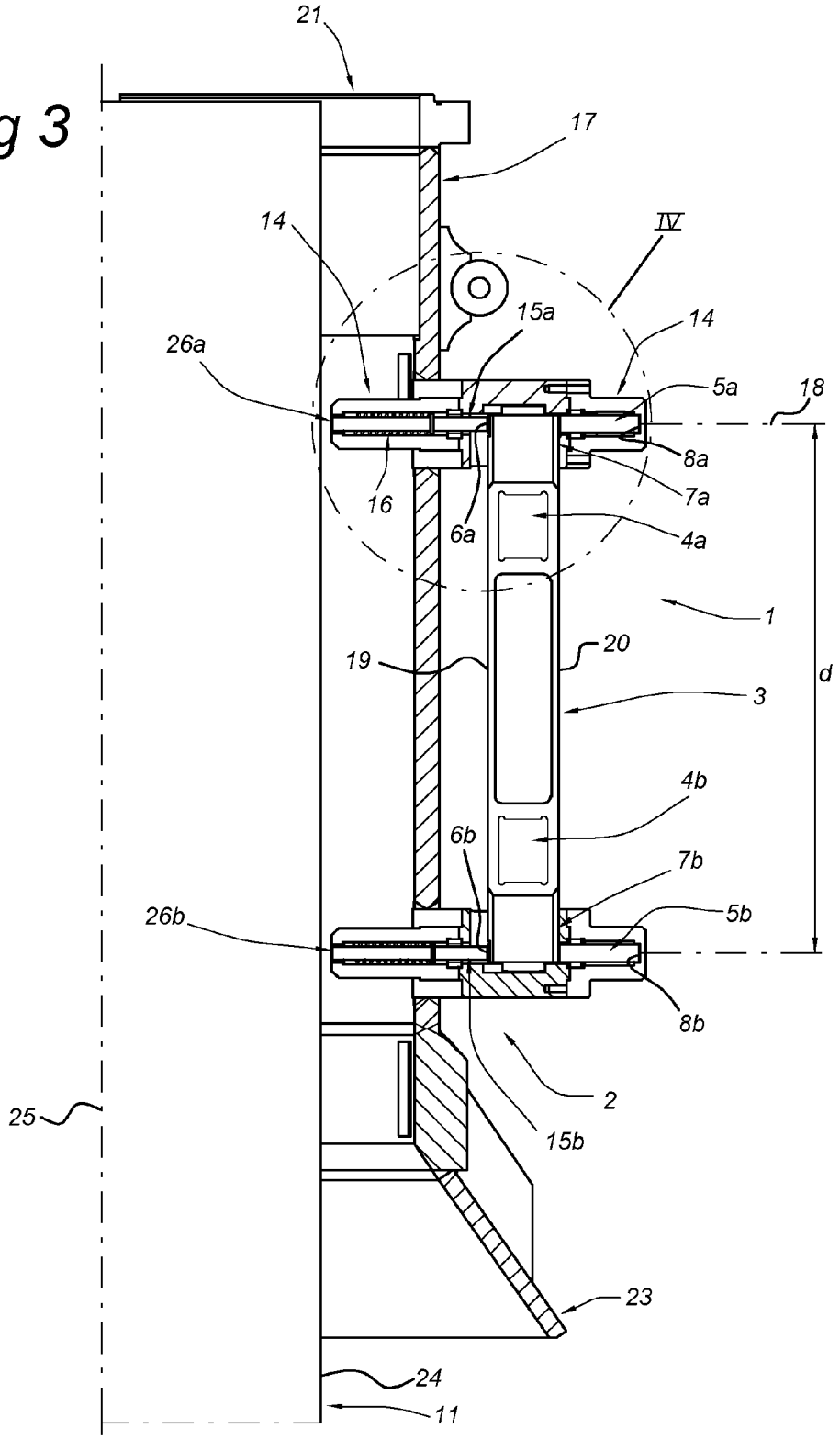
Figure 4:
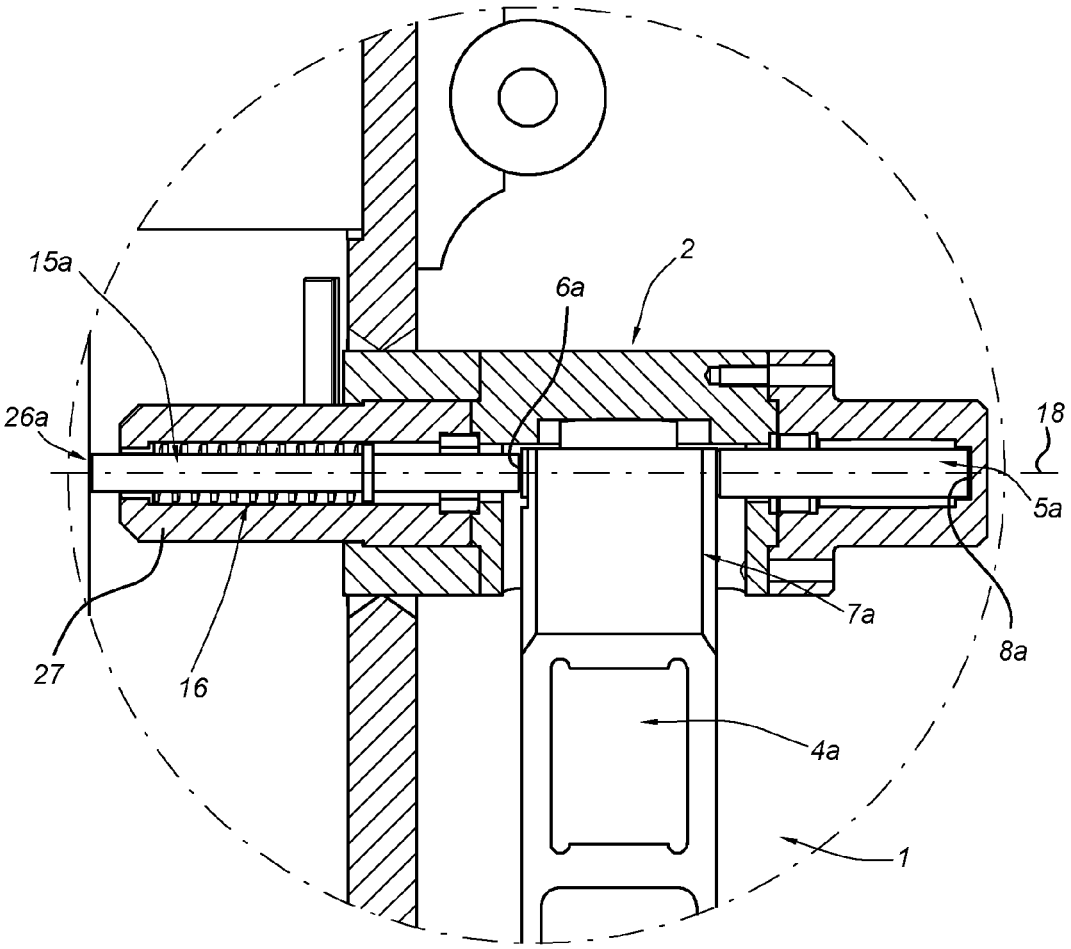

FIG. 1 shows in perspective view a pile driving system 10 with two measuring systems 1 according to the invention. The two measuring systems 1 are mutually arranged such that the perpendicularity of the pile 11 is measured in two orthogonal planes of the pile 11. The two measuring systems 1 are provided with a sleeve element 9 of the pile driving system 10. The sleeve element 9 has a circumferential wall section 17 which surrounds the top end of the pile 11 for aligning the pile driving system 10 with the pile 11. The two measuring systems 1 are provided with the outside surface of the wall section 17. The wall section 17 therefore separates the measuring system 1 from the pile 11 which is beneficial. The wall section 17 is provided with measuring system side covers 22 for protecting the measuring system 1. Here, a hammering device of the pile driving system 10 is joined with the sleeve element at top side of the sleeve element 9. Here, the hammering device is joined with a closing member 21 which closing member closes off the sleeve element 9 and abuts the pile 11 for transmitting driving forces to drive the pile 11. The wall section 17 is joined with the closing member 21. At its lower side, the wall section 17 is provided with a leading collar 23 which provides a tapering for facilitating placing of the sleeve element 9 on top of a pile 11. The measuring system 1 will now be described referring to FIGS. 1-4.

The measuring system 1 is suitable for measuring perpendicularity for the purpose of controlling perpendicularity of a pile 11 during driving of the pile 11. In this case, the pile 11 is coupled with a schematically depicted vessel 12 by means of a pile guiding system 13 in a known manner. Here, the pile guiding system 13 is provided at deck level of the vessel 12.

The pile driving system 10 is coupled with a pile 11 for hammering or driving the pile 11 downwards. The pile driving system 10 is coupled with the pile 11 by means of a sleeve member 9. The sleeve member 9 is coupled with the upper side of the pile 11. The sleeve member 9 surrounds the top side of the pile 11 and extends along the pile 11 in the longitudinal direction of the pile 11 for positioning the pile driving system 10 relative to the pile 11. The sleeve member 9 is provided with two measurement systems arranged for measuring the perpendicularity of the pile 11 in two orthogonal planes.

The measurement system 1 comprises a mounting frame 2 for coupling the measuring system 1 with a pile 11 driving system. Here, the mounting frame 2 is fixedly coupled with the sleeve member 9 in a known manner, specifically coupled with the wall section 17 of the sleeve member 9. The mounting frame 2 is provided at the exterior of the circumferential wall section 17 of the sleeve member 9.

The measurement system 1 comprises a measuring frame 3 for engaging the pile 11. The measuring frame 1 extends along the wall section 17, in use substantially in parallel with the longitudinal axis 25 of the pile 11. The measuring frame 3 is provided with at least one, in this case two, measuring devices 4*a*, 4*b* for measuring perpendicularity of the pile 11. The measuring device 4*a*, 4*b* may be an inclino known per se or any other device suitable for measuring perpendicularity. The measuring frame 3 is moveably coupled with the mounting frame 2. In this case the measuring frame 3 is coupled with the mounting frame 2 by means of a measuring frame driving system 5*a*, 5*b*, and a passive resilient member 16. The driving system 5*a*, 5*b* is schematically depicted and may comprise any suitable actuator known per se, like e.g. a pneumatic cylinder.

The measuring frame is held between the measuring frame driving system 5*a*, 5*b*, and the passive resilient member 16 for coupling the measuring frame 3 without play with either the mounting frame 2 or the pile 11. The measuring frame 3 is moveable between a first position for engaging the pile 11 for measuring the perpendicularity of the pile 11, and a second position for engaging the pile driving system 10, specifically the sleeve member 9, more specifically the mounting frame coupled with the sleeve member 9 for measuring perpendicularity of the pile driving system 10. During moving of the measuring frame 3 between the first and second position, the measuring frame 3 is guided by the mounting frame 2.

The measuring system 1 comprises a pretensioning system 14 for pretensioning the measuring frame towards one of the first and the second position for measuring perpendicularity in a reproducible manner. The pretensioning system 14 is coupled with the mounting frame 2 and the measuring frame 3 for pretensioning the measuring frame towards one of the first and the second position.

The pretension system comprises a passive resilient member 16 for pretensioning the measuring frame 3 towards the second position for engaging the mounting frame 2 for measuring perpendicularity of the pile driving system 10.

The pretension system 14 comprises a measuring frame driving system 5*a*, 5*b* for pretensioning the measuring frame towards the first position for engaging the pile 11 for measuring the perpendicularity of the pile 11.

The pretensioning system 14 has line of action 18 along which line the measuring frame 3 is moveable between the first and second position. In use, the line of action 18 is substantially horizontal.

The measuring frame 3 comprises two measuring frame stop surfaces 6*a*, 6*b* for statically determined engaging the pile 11 for measuring perpendicularity of the pile 11. In use, the at least two measuring frame stop surfaces 6*a*, 6*b* face the pile 11. The two measuring frame stop surfaces 6*a*, 6*b* are mutually spaced apart, one stop surface on each end of the measuring frame 3. Here, the length of the measuring frame 3 is about 2 m such that the stop surfaces 6*a*, 6*b* are spaced apart about that same 2 m. Spacing these measuring frame stop surfaces 6*a*, 6*b* a considerable distance apart, facilitates an accurate measuring of the perpendicularity of the pile 11.

In this case, the measuring frame 3 comprises two further measuring frame stop surfaces 7*a*, 7*b* for statically determined engaging the pile driving system 10, specifically the mounting frame 2 coupled with the pile driving system 10, for measuring perpendicularity of the pile driving system 10. In use, the two further measuring frame stop surfaces 7*a*, 7*b* face away from the pile 11.

The two measuring frame stop surfaces 6*a*, 6*b* for statically determined engaging the pile 11 are provided with a first side 19 of the measuring frame 3 and the at least two further measuring frame stop surfaces 7*a*, 7*b* for statically determined engaging the pile driving system 10 are provided with a second side 20 of the measuring frame 3. The second side 20 of the measuring frame 3 is opposite relative to said first side 19.

The mounting frame 2 comprises, in this case, two mounting frame stop surfaces 8*a*, 8*b* for the pile driving system 10 being statically determined engaged by the measuring frame 3 via the mounting frame 2 for measuring perpendicularity of the pile driving system 10, specifically the sleeve member 9, more specifically the wall section 17 of the sleeve member 9.

Here, the measuring system 1 comprises two elongate members 15*a*, 15*b* coupled with the measuring frame 3 for the measuring frame 3 engaging the pile 11 by means of the two elongate members 15*a*, 15*b*. The elongate members 15*a*, 15*b* extend between from the measuring frame 3 towards the pile 11 for facing the pile 11. In use, the elongate member 15*a*, 15*b* extend through the sleeve member 9 and engage the pile 11 for measuring the perpendicularity of the pile 11. The elongate members 15*a*, 15*b* are accommodated each in a cylindrical housing part 27. The elongate members 15*a*, 15*b* are moveably held in their respective housing part 27. The elongate members 15*a*, 15*b* are coupled with the measuring frame 3 such that the elongate members 15*a*, 15*b* move with the measuring frame 3.

The elongate members 15*a*, 15*b* respectively face the two measuring frame stop surfaces 6*a*, 6*b* with one end of the elongate member 15*a*, 15*b*. In use the respective other end of the elongate members 15*a*, 15*b* face the pile 11, specifically the outside surface 24 of the pile 11. Therefore, the respective elongate members 15*a*, 15*b* are provided with respective elongate member stop surfaces 26*a*, 26*b* for statically determined engaging the pile 11 to measure perpendicularity of the pile 11.

In this case, the mounting frame 2 has a mounting frame upper part and a mounting frame lower part, which parts correspond. The measuring frame 3 is held by the mounting frame 2, specifically between the mounting frame upper part and the mounting frame lower part, in a measuring frame vertical plane which plane intersects with the pile 11, preferably with the central longitudinal axis 25 of the pile 11. In use, the measuring frame is moveable between the first and second position in the measuring frame vertical plane. The measuring frame 3 is guided in the measuring frame vertical plane by the mounting frame 2, specifically by sliding means of the mounting frame 2 and the measuring frame 3. In use, the measuring system 1 measures the perpendicularity of the pile 11 relative to a vertical plane which plane is orthogonal relative to the measuring frame vertical plane wherein the measuring frame 3 is moveable.

The measuring frame 3 is held moveable in its measuring frame vertical plane by the mounting frame upper part and the mounting frame lower part of the mounting frame 2 such that the measuring frame 3 is able to translate and rotate in the measuring frame vertical plane.

The measuring frame 3 is coupled with the mounting frame 2 by means of the pretension system 14 for holding the measuring frame 3 moveable in the measuring frame vertical plane without play. In this case, both the mounting frame upper part and the mounting frame lower part of the mounting frame 2 are provided with a pretension system 14. The pretension system 14 extends on both sides of the measuring frame 3. The pretension system 14 comprises a passive resilient member, in this case a coil spring 16. The spring 16 forces the measuring frame 3 towards its second position such that accelerations of the pile 11 caused by the hammering do not harm the measuring device 4*a*, 4*b* provided with the measuring frame 3. The spring 16 is coupled with the measuring frame 3 via the elongate member 15*a* for forcing the measuring frame 3 towards its second position. The pretension system 14 comprises a measuring frame driving system 5*a*, 5*b* which is schematically depicted. The measuring frame driving system 5*a*, 5*b* has a line of action 18 in the measuring frame vertical plane. The measuring frame driving system 5*a*, 5*b* is arranged for driving the measuring frame from the second position towards the first position. The driving system 5*a*, 5*b* drives the measuring frame 2 against the spring 16.

The mounting frame 2 and the measuring frame 3 are arranged such that the two measuring frame stop surfaces 6*a*, 6*b*, the two further measuring frame stop surfaces 7*a*, 7*b* and the two mounting frame stop surfaces 8*a*, 8*b* are aligned which is beneficial in terms of measurement accuracy. In this case, the pretension system 14 is aligned with the above mentioned stop surfaces as well, which is even more beneficial in terms of measurement accuracy.

During use in a method for driving a pile using a measuring system 1 according to the invention, the method comprises the step of at least once moving, specifically tilting, the measuring frame 3 between the first and the second position for measuring the perpendicularity of one of the pile 11 and a pile driving system 10 using one and the same measuring frame 3.

Figure 5:
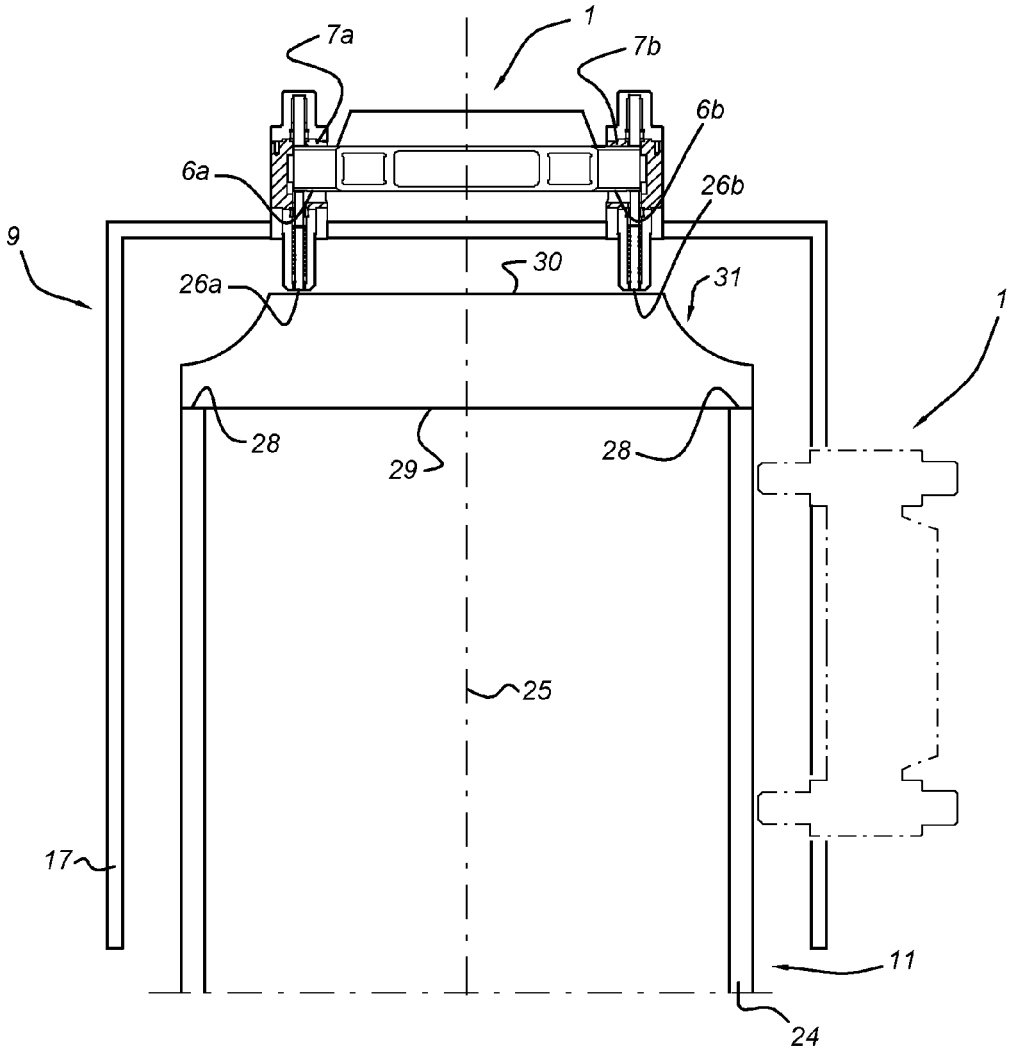

FIG. 5 schematically depicts the sleeve member 9 of the pile driving system 10 (not shown here) provided with measuring system 1 of the invention. The pile driving system is provided with two measurement systems 1. The upper measurement system 1, which is shown in detail engages the top surface 28 of the pile 11. The upper measuring system 1 is coupled with the pile via a striking plate 31. The striking plate 31 has a first striking plate plane 29 coupled with the top surface 28 of the pile 11. The striking plate 31 has a second striking plate plane 30 which is, in use, coupled with the upper measurement system 1 for providing a reference plane therefor to measure deviation of the top surface 28 of the pile 11 with the true horizontal.

The lower measurement system 1, which is schematically shown, engages the exterior circumference 24 of the pile 11 for measuring perpendicularity of the pile 11.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A measuring system for controlling perpendicularity of a pile during driving of the pile, wherein the measurement system comprises;

a mounting frame for coupling the measuring system with a pile driving system, and a measuring frame provided with at least one measuring device for measuring perpendicularity, the measuring frame being moveably coupled with the mounting frame and moveable between a first position for engaging the pile for measuring the perpendicularity of the pile, and a second position for engaging the pile driving system for measuring perpendicularity of the pile driving system.

2. The measuring system according to claim 1, comprising a pretensioning system coupled with the mounting frame and the measuring frame for pretensioning the measuring frame towards one of the first and the second position for measuring perpendicularity in a reproducible manner.

3. The measuring system according to claim 2, wherein the pretension system comprises a passive resilient member for pretensioning the measuring frame towards one of the first and the second position.

4. The measuring system according to claim 2, wherein the pretension system comprises a measuring frame driving system for driving and/or pretensioning the measuring frame towards one of the first and the second position.

5. The measuring system according to claim 4, wherein the passive resilient member is arranged for pretensioning the measuring frame towards the second position and the frame driving system is arranged for pretensioning the measuring frame towards the first position.

6. The measuring system according to claim 2, wherein the pretensioning system, in use, has line of action along which line the measuring frame is moveable between the first and second position, wherein the line of action is substantially horizontal.

7. The measuring system according to claim 1, wherein the measuring frame comprises at least two measuring frame stop surfaces for statically determined engaging the pile for measuring perpendicularity of the pile.

8. The measuring system according to claim 7, wherein the measuring frame comprises at least two further measuring frame stop surfaces for statically determined engaging the pile driving system for measuring perpendicularity of the pile driving system.

9. The measuring system according to claim 8, wherein the at least two further measuring frame stop surfaces are arranged for statically determined engaging the mounting frame for measuring perpendicularity of the pile driving system.

10. A measuring system according to claim 9, wherein the at least two measuring frame stop surfaces for statically determined engaging the pile are provided with a first side of the measuring frame and the at least two further measuring frame stop surfaces for statically determined engaging the pile driving system are provided with a second side of the measuring frame, said second side being opposite relative to said first side.

11. The measuring system according to claim 8, wherein the at least two measuring frame stop surfaces for statically determined engaging the pile are provided with a first side of the measuring frame and the at least two further measuring frame stop surfaces for statically determined engaging the pile driving system are provided with a second side of the measuring frame, said second side being opposite relative to said first side.

12. The measuring system according to claim 1, wherein the mounting frame comprises at least two mounting frame stop surfaces for the pile driving system being statically determined engaged by the measuring frame via the mounting frame for measuring perpendicularity of the pile driving system.

13. The measuring system according to claim 1, comprising an elongate member for coupling the measuring frame with the pile for measuring the perpendicularity of the pile, wherein the elongate member extends from the measuring frame for facing the pile and engaging the pile for measuring the perpendicularity of the pile.

14. A pile driving system comprising a pile guiding system for coupling the pile with a vessel, the pile guiding system having an elongate leader and a saddle, a pile driving device, the measurement system according to claim 1 coupled with the pile driving device or with the pile guiding system.

15. The pile driving system according to claim 14, wherein the measurement system is coupled with a reference plane of the pile.

16. The pile driving system according to claim 15, wherein the measurement system is coupled with the outer circumference for measuring perpendicularity of the pile.

17. The pile driving system according to claim 15, wherein the measurement system is coupled with the top surface of the pile for measuring deviation of the top surface with the true horizontal.

18. A method for driving a pile using the measuring system according to claim 1, comprising at least once executing the step of, moving, specifically tilting, the measuring frame between the first and the second position for measuring the perpendicularity of one of the pile and a pile driving system using one and the same measuring frame.

* * * * *